US005901847A

United States Patent [19]

Colby et al.

[11] Patent Number: 5,901,847

[45] Date of Patent: May 11, 1999

[54] PACKAGE FOR CONTAINER AND PACKAGING METHOD

[75] Inventors: William Neil Colby, Cheshire; Stephen Scott, Lancashire; Julian Harry James Stocker; Michael John Claydon, both of Merseyside; Margaret Burke, Christopher John Andrew Barnardo, both of London; Gregory Berman, Cambridge; William George Dando, Berwickshire; David John Livesley, Cambridgeshire; William Frank Tyldesley, Norfolk; Michelle Claire Watson, Cambridge, all of United Kingdom

[73] Assignee: H. J. Heinz Company Limited, United Kingdom

[21] Appl. No.: 08/952,324

[22] PCT Filed: Apr. 24, 1996

[86] PCT No.: PCT/GB96/00981

§ 371 Date: Mar. 6, 1998

§ 102(e) Date: Mar. 6, 1998

[87] PCT Pub. No.: WO96/33924

PCT Pub. Date: Oct. 31, 1996

[30] Foreign Application Priority Data

Apr. 28, 1995 [GB] United Kingdom ..... 9508714

[51] Int. Cl.[6] ..... B65D 71/00

[52] U.S. Cl. ..... 206/427; 53/398; 206/446; 206/459.5; 220/23.4

[58] Field of Search ..... 206/150, 162, 206/427, 432, 433, 446, 459.5; 220/23.4, 23.8, 23.2, 23.6; 53/397, 398, 399

[56] References Cited

U.S. PATENT DOCUMENTS

| | | | |
|---|---|---|---|
| 3,097,740 | 7/1963 | Poupitch | 206/150 |
| 3,360,179 | 12/1967 | Carstens | 229/15 |
| 3,392,876 | 7/1968 | Allred | 206/150 |
| 3,938,656 | 2/1976 | Owen | 206/150 |
| 4,721,222 | 1/1988 | Haythornthwaite | 206/23.4 |

FOREIGN PATENT DOCUMENTS

| | | |
|---|---|---|
| 0 527 451 | 8/1992 | European Pat. Off. . |
| 1 398 565 | 3/1965 | France . |
| 1 446 223 | 6/1966 | France . |
| 2 157 215 | 5/1973 | France . |
| 1044181 | 9/1966 | United Kingdom . |

*Primary Examiner*—Jim Foster
*Attorney, Agent, or Firm*—St.Onge Steward Johnston & Reens LLC

[57] ABSTRACT

A multi-pack comprising a plurality of containers, each having a respective label attached thereto, and packaging for holding said plurality of containers together, wherein the packaging is formed from a strip of sheet material which also constitutes at least part of said labels, and the packaging includes a plurality of connecting portions each of which extends from one to the other of a respective contiguous pair of the containers to join those containers together.

25 Claims, 13 Drawing Sheets

PACKAGE FOR CONTAINER AND PACKAGING METHOD

The invention relates generally to the field of packaging and more specifically to a packaging method and to a multi-pack comprising a plurality of containers.

It is known to secure containers, particularly bottles, cans or cartons which contain drink or food, into groups of four, six, eight or twelve for portability. Such a group is referred to herein as a multi-pack. The containers of each group may be held in an array of rows and columns which (when viewed in plan) is generally rectangular, by a cardboard "outer" or carcass. The carcass extends around the outside of the multi-pack, and may carry identifying graphics or promotional material which is to be visible when the multi-pack is stacked on a shelf. Providing a carcass and disposing it about the grouped containers can add a significant amount to the cost of producing the multi-pack.

Those costs can be reduced by providing a carcass which only extends around some of the sides (normally the front, rear top and bottom) of the multi-pack. However, this approach does not avoid the need for a separate carcass and is less effective at holding the containers together (unless those containers are glued to the carcass).

A further disadvantage of multi-packs including a carcass, is that containers can be inadvertently detached from the rest of the multi-pack while the latter is, for example, being carried by a consumer. This disadvantage also applies to a second type of multi-pack, usually of cans in which an array of interconnected plastic rings disposed about the can necks holds the cans in position.

It is an object of the present invention to at least partially overcome some of the above-mentioned difficulties.

According to a first aspect of the invention, there is provided a packaging method comprising the steps of

- interposing a plurality of containers between first and second opposed web portions of material;
- securing the web portions together at regions between adjacent containers, whereby the material extends on the periphery of the containers and provides a hinged connection between adjacent containers;
- disposing the containers in a multi-pack configuration; and
- securing a first container at an end of the web portions to another container of said plurality to retain the containers in said multi-pack configuration.

Preferably said securing step comprises: providing a flap projecting from said first container and attaching that flap to said another container.

Advantageously, the providing step comprises forming the flap from free adjacent ends of the first and second web portions.

In one embodiment, the flap forming step comprises attaching the ends of the web portions together by adhesive.

In another embodiment, the flap forming step comprises heat sealing the ends of the web portions together.

Advantageously, the disposing step comprises disposing the containers such that successive connecting portions are mutually substantially perpendicular.

According to a second aspect of the invention, there is provided a multi-pack comprising a plurality of containers, each having a respective label attached thereto, and packaging for holding said plurality of containers together, wherein the packaging is formed from a strip of sheet material which also constitutes at least part of said labels, and the packaging includes a plurality of connecting portions each of which extends from one to the other of a respective contiguous pair of the containers to join those containers together, wherein the sheet material comprises a continuous elongate strip which constitutes part of the labels of all the containers, so that said connecting portions are seamless, the packaging including fastening means securing a container which, by virtue of being at a region of an end of the strip, has only one said connecting portion extending therefrom, to another container in the multi-pack to prevent relative movement of said containers.

Because the material of the packaging serves both to secure the containers into a multi-pack and as labels for the containers, there is no need to provide a separate carcass. This enables the multi-pack to be formed relatively cheaply. Since the connecting portions are an integral part of the same strip, this arrangement can (with appropriate selection of the material of the strip and means of attachment to the containers) provide a relatively strong connection between all the containers in the multi-pack. This helps to avoid containers becoming detached from the multi-pack when being removed from a shelf.

Conveniently, said fastening means comprises a flap constituted by at least part of the end of the strip, which is secured to a container in the multi-pack to retain the containers in configuration.

In some of the embodiments the containers are disposed so that successive connecting portions are mutually substantially perpendicular.

Where the multi-pack has four containers, these are preferably arranged in an array which, viewed in plan, consists of two rows and two columns, each of two contiguous containers, wherein the containers in one column are joined to each other, and to respective containers in the other column, by corresponding connecting portions and the containers in said other column are joined together by said flap.

Alternatively, where the multi-pack has more than four containers, these are preferably disposed in n columns, each of m contiguous containers, and m rows each of n contiguous containers, and n is three or more, and wherein one of the connecting portions constitutes a bridging connecting portion which extends from an end of a container at an end of a first column at one side of the rows to a container at a corresponding position in a second column at the opposite side of the rows, the flap extending from a container at the opposite end of the second column to a container in a corresponding position in another column, wherein the bridging connecting portion engages at least one container in an intermediate column between the first and second columns.

Preferably said container in the intermediate column is a container which, by virtue of being at an end of the strip, only has one connecting portion projecting therefrom.

Thus, for example, in a six container multi-pack, the containers are arranged in three columns of two and two rows of three containers, the bridging connecting portion extends from the top of the first to the top of the third column and the container at the top of the second column is one of the containers with only one seamless connecting portion.

Since the bridging connecting portion extends across the whole width of the multi-pack, it can carry relatively large scale graphics and promotional literature for the multi-pack as a whole.

Alternatively, the containers are held together in other configurations. For example, the containers of a six container multi-pack may be held together in a configuration which is generally hexagonal, when viewed in plan.

Preferably, the strip is one of a pair of such strips, between which each container is sandwiched, the entire label of each container being constituted by said strips.

The use of two strips helps to prevent any container in the multi-pack from being detached from its label, and hence from the remaining containers.

Advantageously, the connecting portions of the two strips are joined together so as to provide composite connecting portions, each of which preferably has a thickness which is at least the sum of the thicknesses of the individual strips.

As a result, the connecting portions are more robust than the portions of the strips constituting the labels.

Conveniently, each strip is of high tear strength paper.

Preferably, each connecting portion includes a line of weakening for enabling a connecting portion to be split into two, and thus to allow each container to be separated from the other containers in the multi-pack when needed.

Preferably, where the strips are of high tear strength paper, the strips are attached to the containers, and to each other, in the connecting portions, by means of an adhesive. The adhesive can also help to fortify the composite connecting portions.

According to a third aspect of the invention, there is provided a multi-pack comprising a plurality of containers held together by packaging, the packaging comprising at least one strip of sheet material, between respective portions of which each container is sandwiched, the portions being secured together at intervals to provide hinging connecting portions each of which extends between, and joins together, a respective contiguous pair of containers, and further comprising at least one strip of sheet material, between respective portions of which each container is sandwiched, the portions being secured together at intervals to provide hinging connecting portions each of which extends between and joins together a respective contiguous pair of containers, and further comprising fastening means securing one of said containers to another container whereby said containers are retained in a multi-pack configuration.

The sheet material thus holds each individual container in the multi-pack rather than merely pushing one container against another, as is the case with multi-packs which have cardboard outers.

Also, the sheet material may provide substantial torsional rigidity especially where it extends over a substantial part of the height of the containers, and this is advantageous where the multi-pack has a large number of containers (for example, six or more).

Advantageously the sheet material comprises a continuous elongate strip engaging each of said plurality of containers.

The packaging for the multi-pack can be formed from a single strip of sheet material turned back on itself. Preferably, however, the packaging comprises two opposed strips of material bonded together.

Conveniently, the containers are disposed so that consecutive connecting portions are disposed mutually substantially at right angles.

The strips may be of paper. Alternatively the strips may be of a transparent material. In this case, the containers (or any markings or labels thereon) would be visible through the packaging for the multi-pack. Alternatively the strips may be non-transparent, e.g. carrying printed matter.

The sheet material preferably comprises a plastics material, for example polythene (polyethylene), polypropylene, polyvinyl chloride (PVC) or polyester (PET).

Preferably, the strips are bonded together at their ends and at said intervals by a process of heat sealing.

Conveniently, the sheet material may comprise a laminate, having a layer of material (for example PVC or PET) which is not readily heat sealable to itself, and a further layer of material, such as polypropylene, which is readily heat sealable to itself.

Conveniently, the containers are gripped by the sheet material, thus avoiding the need for any adhesive.

Preferably, the multi-pack includes a handle which is conveniently integrally formed in one of the two pairs of corresponding ends of the strips.

The containers of the multi-pack can be arranged in a block configuration of rows and columns, or in any other convenient configuration. One example of the latter for six containers is a generally hexagonal configuration (viewed in plan).

Embodiments of the invention will be described, by way of example, with reference to the accompanying drawings, in which.

Figure 2:
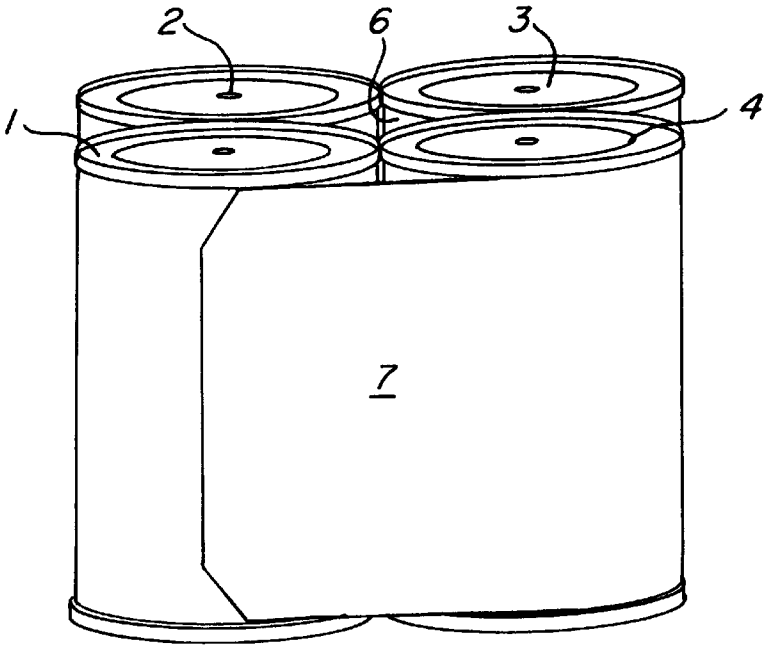
FIG. 2 shows the four-pack from the opposite side.
Figure 1:
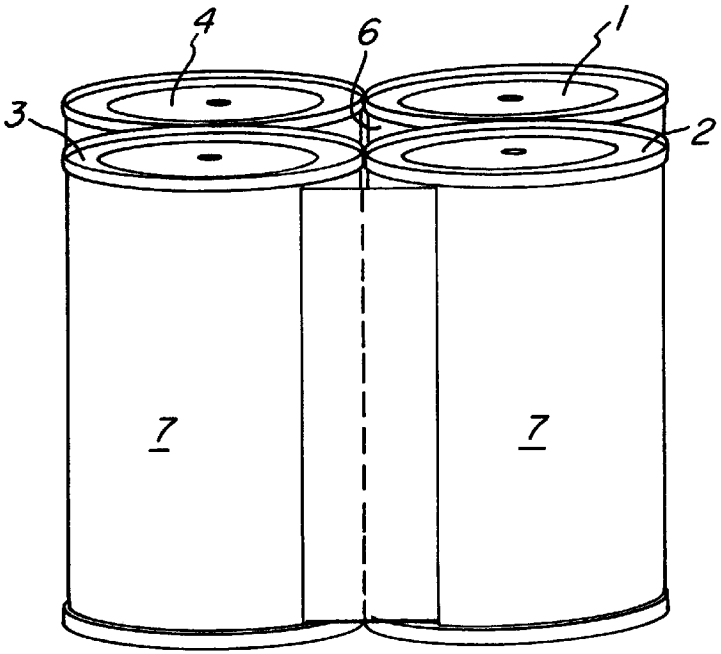
FIG. 1 is a side view of a first multi-pack, a so-called "four-pack", in accordance with the invention.
Figure 3:
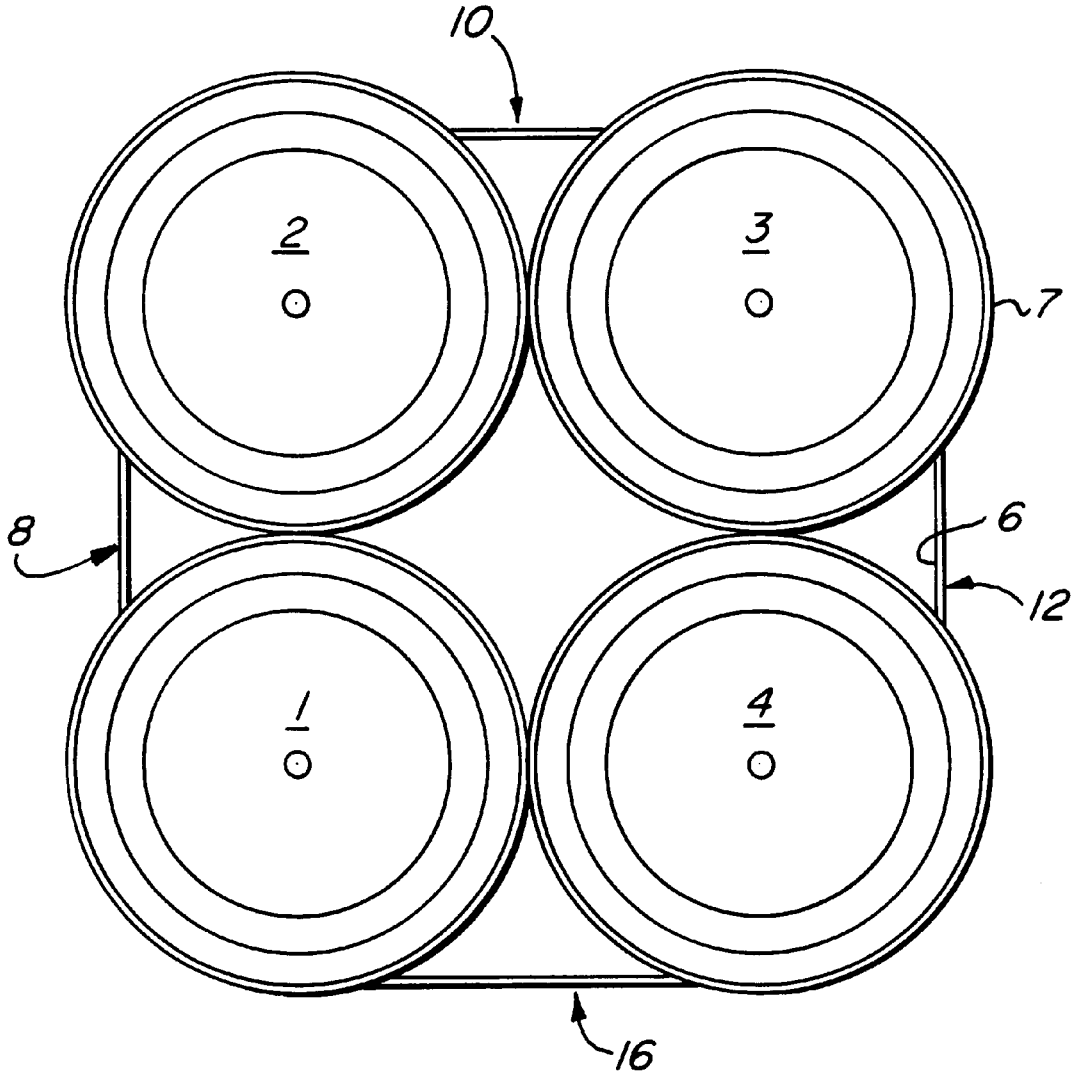
FIG. 3 is a plan view of the four-pack.

The four-pack shown in FIGS. 1–3 comprises four cans 1, 2, 3 and 4 of food. The cans shown in the figures are cylindrical, but other shapes of containers are, of course, possible. For example containers having a generally rectangular or square base, and substantial parallel side walls could be used. The cans 1–4 are arranged in a generally cuboid, unitary structure which, when viewed in plan (as in FIG. 3), has two columns and two rows, each of two contiguous cans. Thus the cans 1 and 2 are in one column as viewed in FIG. 3, whilst the cans 3 and 4 are in the other column.

Figure 4:
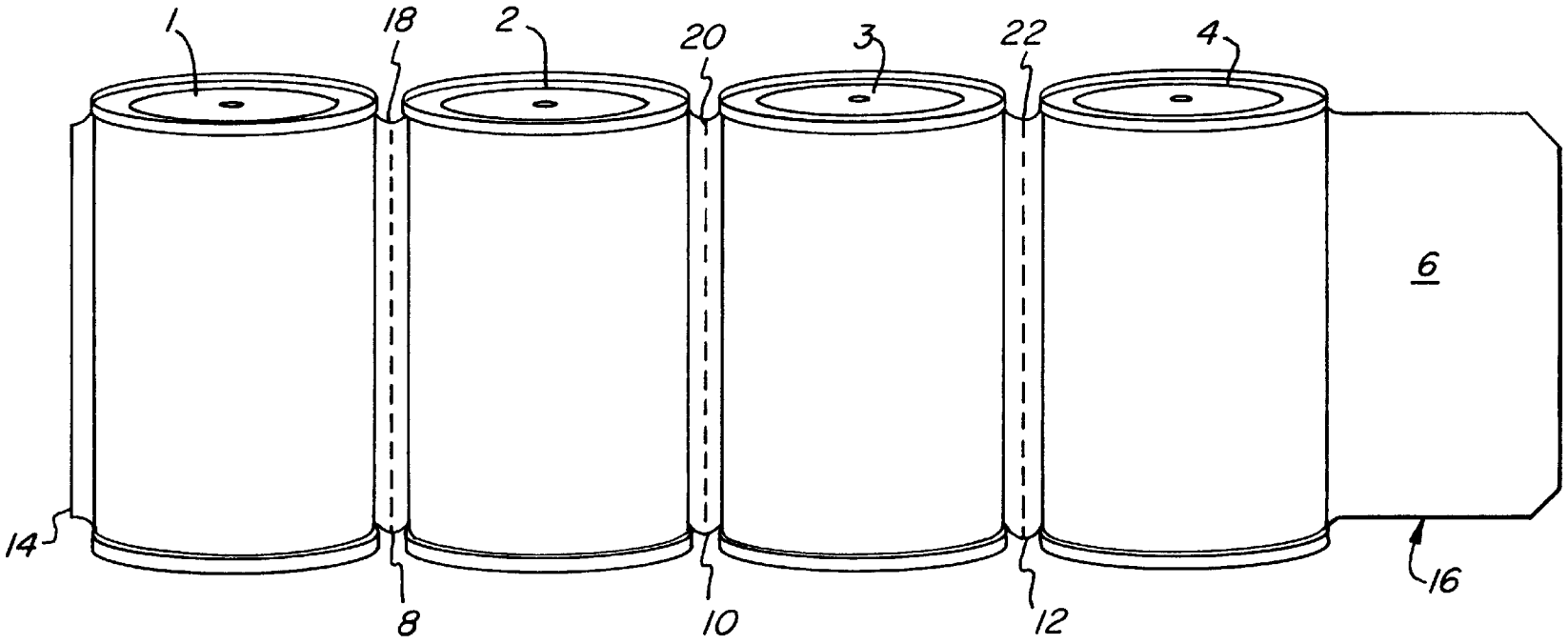
FIG. 4 shows the containers of the four-pack with packaging for holding the four-pack together but before the containers are formed into the configurations shown in FIGS. 1–3.

FIG. 4 shows the cans before being placed in that configuration. As can be seen from that Figure, the cans are all secured to a first strip 6 of material, such as high tear strength paper which extends approximately halfway round on the periphery of the cylindrical surface of each can. A second strip 7 of the material extends around the other half of each can.

Both strips extend over substantially the entire height of the cans. This is however a feature of this embodiment, and other arrangements for example, where the strips do not cover the full height, may be employed either with cans or other containers.

The two strips of paper are pre-treated by the application of an adhesive layer which sticks the strips of paper to the cans and are also pre-printed with graphics identifying the product, and thus also constitute the whole or part of the labels for the containers.

As shown in FIG. 4, the cans form a linear array in which they are spaced from each other and the portions of the strips between adjacent cans are secured together to provide a respective one of three hingeable connecting portions, 8, 10 and 12, each of which extends between a respective adjacent pair of cans. The connecting portions are dimensioned to enable the cans to be spaced apart sufficiently to be hinged with respect to one another. For a four pack configuration of circular containers, an even container spacing along the strips to provide connecting portions whose length is 0.585 times the container radius ($2r[1-\sqrt{1/2}]$) causes the connecting portions to be in tension once the containers are disposed in that configuration. Other spacings are of course possible. At one end the two strips are secured together at the can 1 to provide a seam 14, whilst the opposite end of the strips are attached together adjacent the can 4, using the adhesive, to provide fastening means in the form of a flap 16. An adhesive is applied to the flap 16. Alternatively other fastenings could be used, such as an added adhesive label or the like.

A respective line of weakening, here a line of perforations 18, 20 and 22, is provided in each connecting portion to enable cans to be separated, one at a time, from the others. In a modified version of this embodiment, each connecting portion includes two parallel lines of perforations which define a respective tear away strip.

Figure 5:
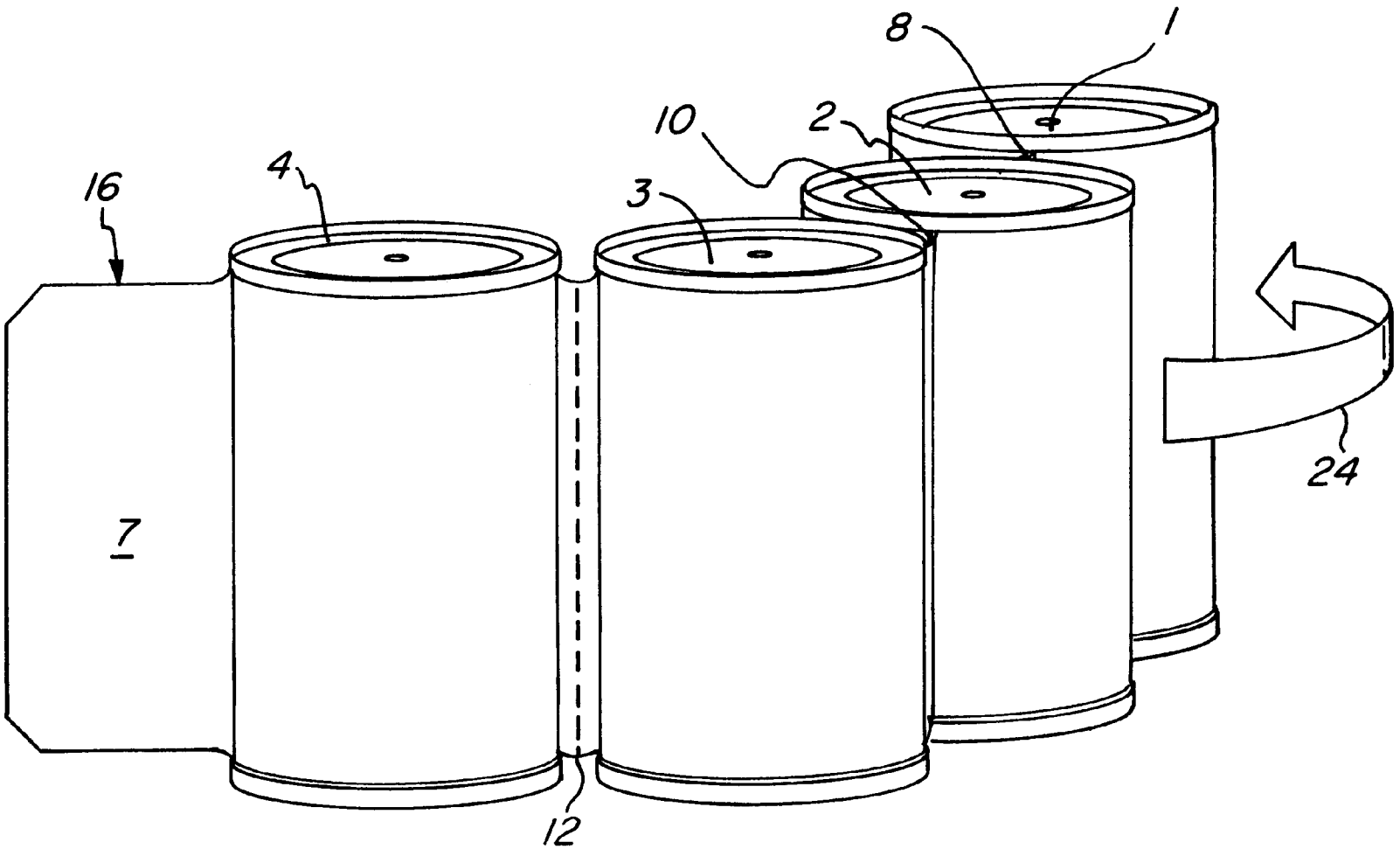
FIGS. 5 and 6 show how the containers are moved relative to each other to achieve the configurations shown in FIGS. 1–3, starting from the configuration as shown in FIG. 4.
Figure 6:
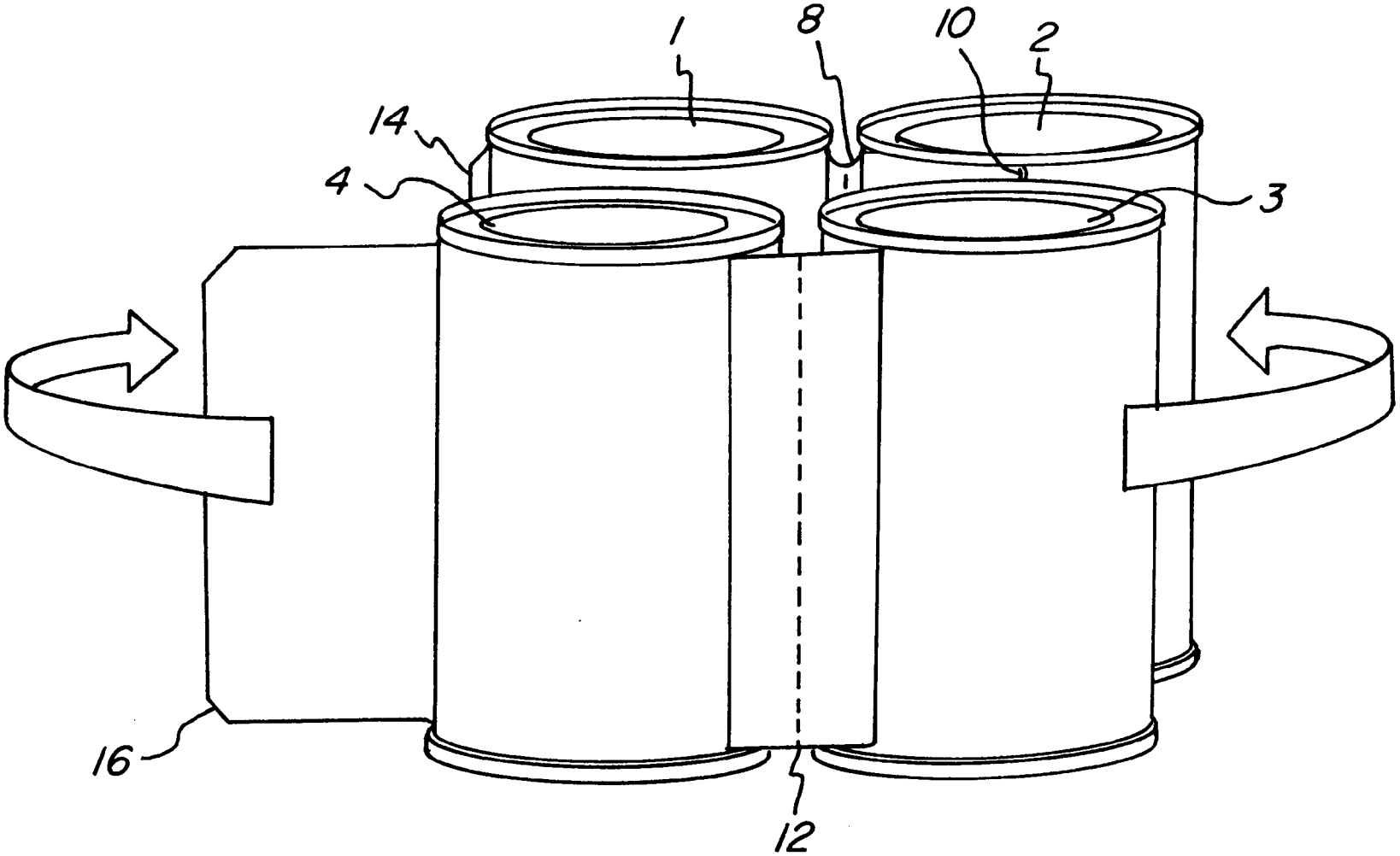

Since the connecting portions 8, 10 and 12 are constituted by paper and adhesive, they provide hinged connections between the cans. Thus the cans 1 and 2 can be hinged relative to the cans 3 and 4 in a direction indicated by the arrow 24 of FIG. 5 until the configuration shown in FIG. 6, in which the cans 2 and 3 are touching, is reached. The cans 1 and 4 are then moved towards each other and rotated slightly about their respective axes which brings them into contact with each other and with the cans 2 and 3 respectively. The connecting portions are then in tension with each connecting portion disposed substantially perpendicular to a neighbouring connecting portion. The fastening means (flap 16) is then attached to the can 1, thereby to secure the cans in the configuration shown in FIGS. 1–3.

With the four-pack held together as shown in FIGS. 1–3, and with the above length of connecting portion (for circular containers) the strips 6 and 7 are under tension, as a result of which the cans are held tightly together at their rims. For other container geometries, simple mathematics is used to determine the required length of connecting portion for tension to occur.

After purchasing the multi-pack, the consumer can peel back the flap 16 and separate the can 4 from the rest of the multi-pack by tearing along the line of perforations 12.

Figure 7:
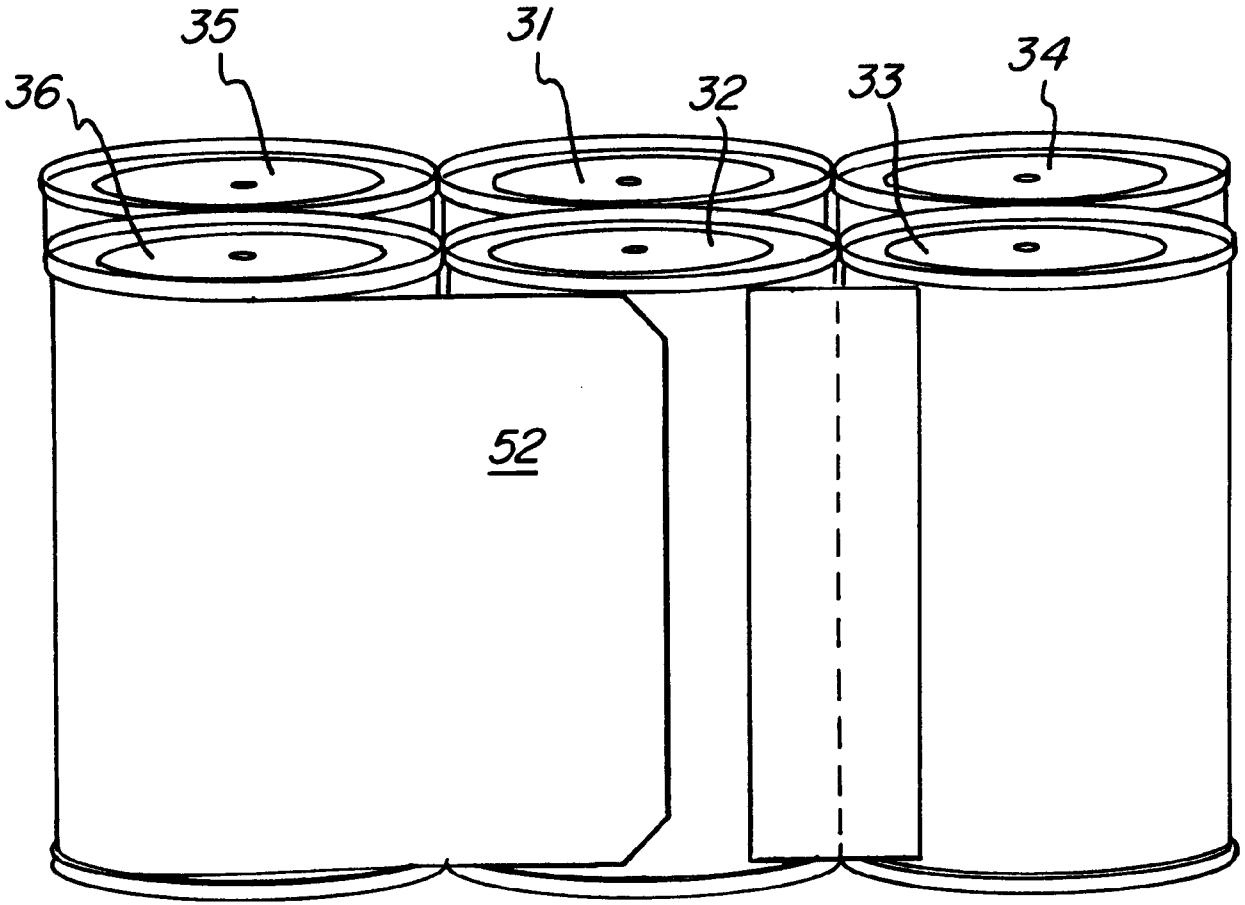
FIG. 7 is a side view of a second multi-pack, a so-called "six-pack"
Figure 8:
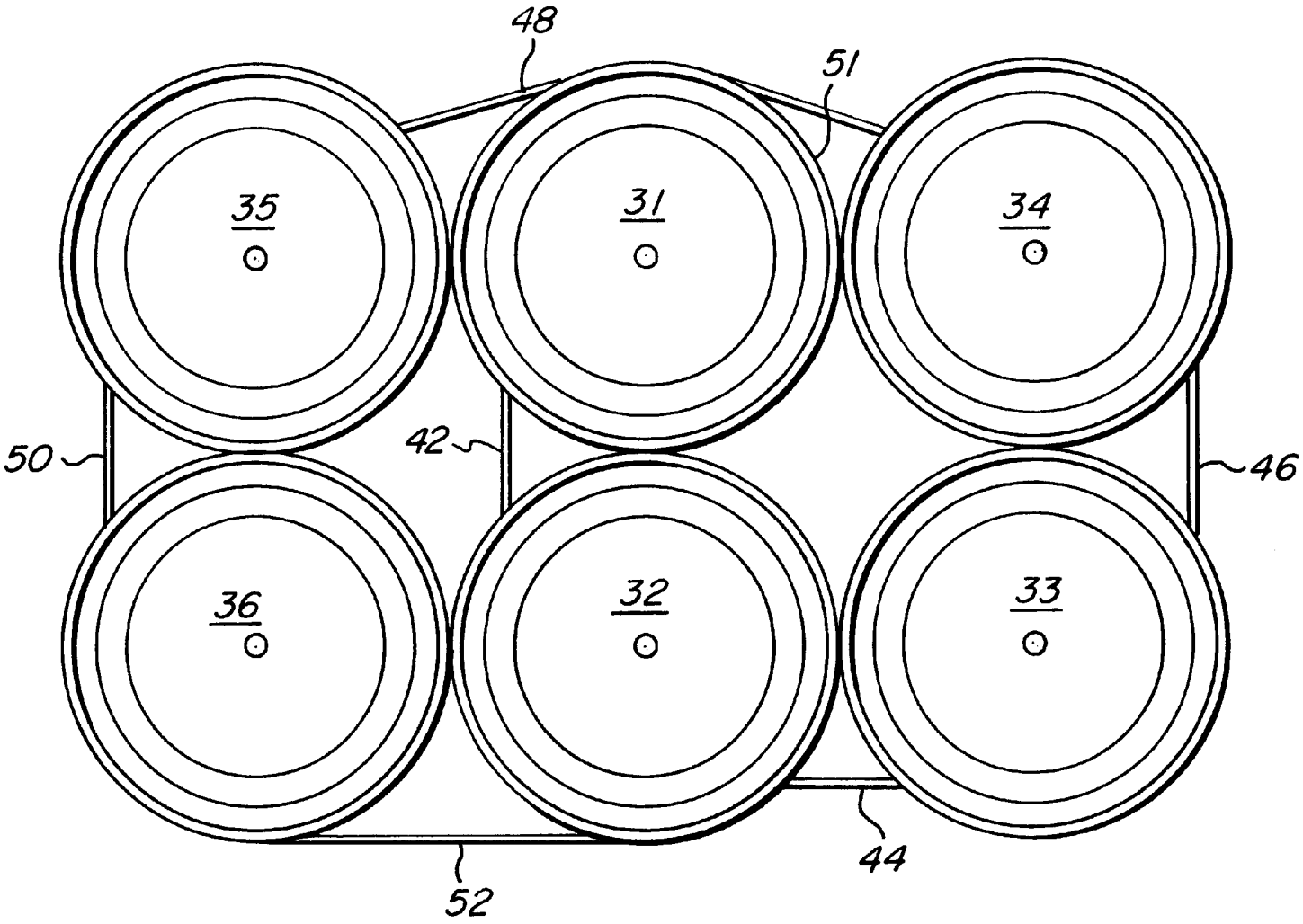
FIG. 8 is a plan view of the six-pack.
Figure 9:
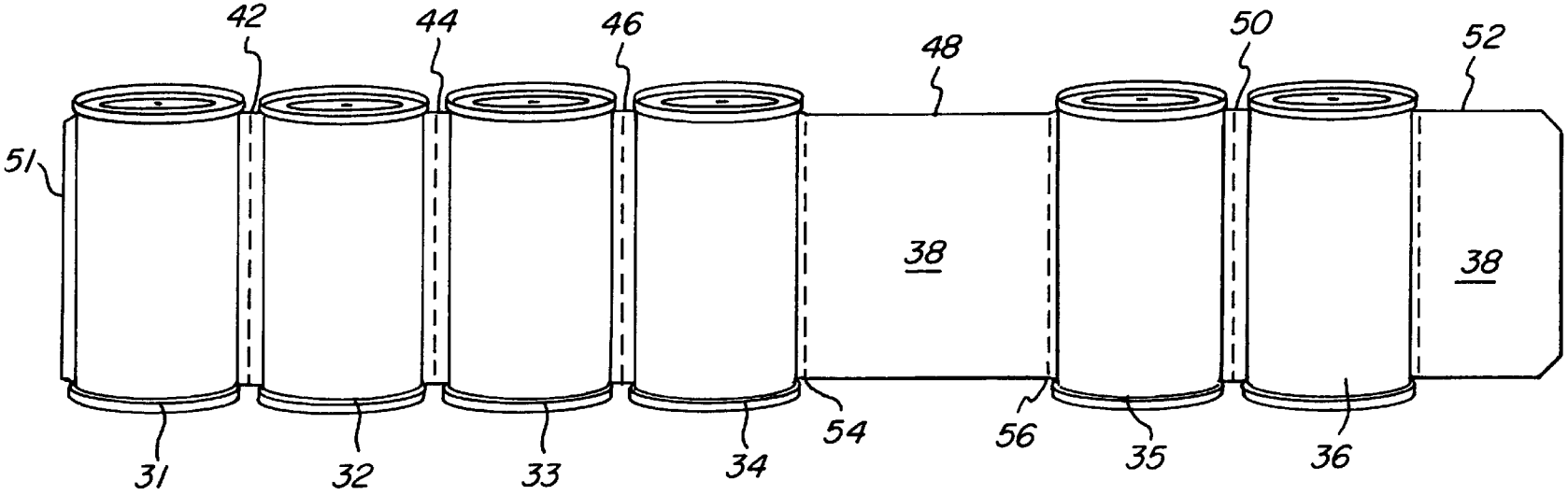
FIGS. 9–11 are views of the six-pack which correspond to FIGS. 4–6 respectively.
Figure 10:
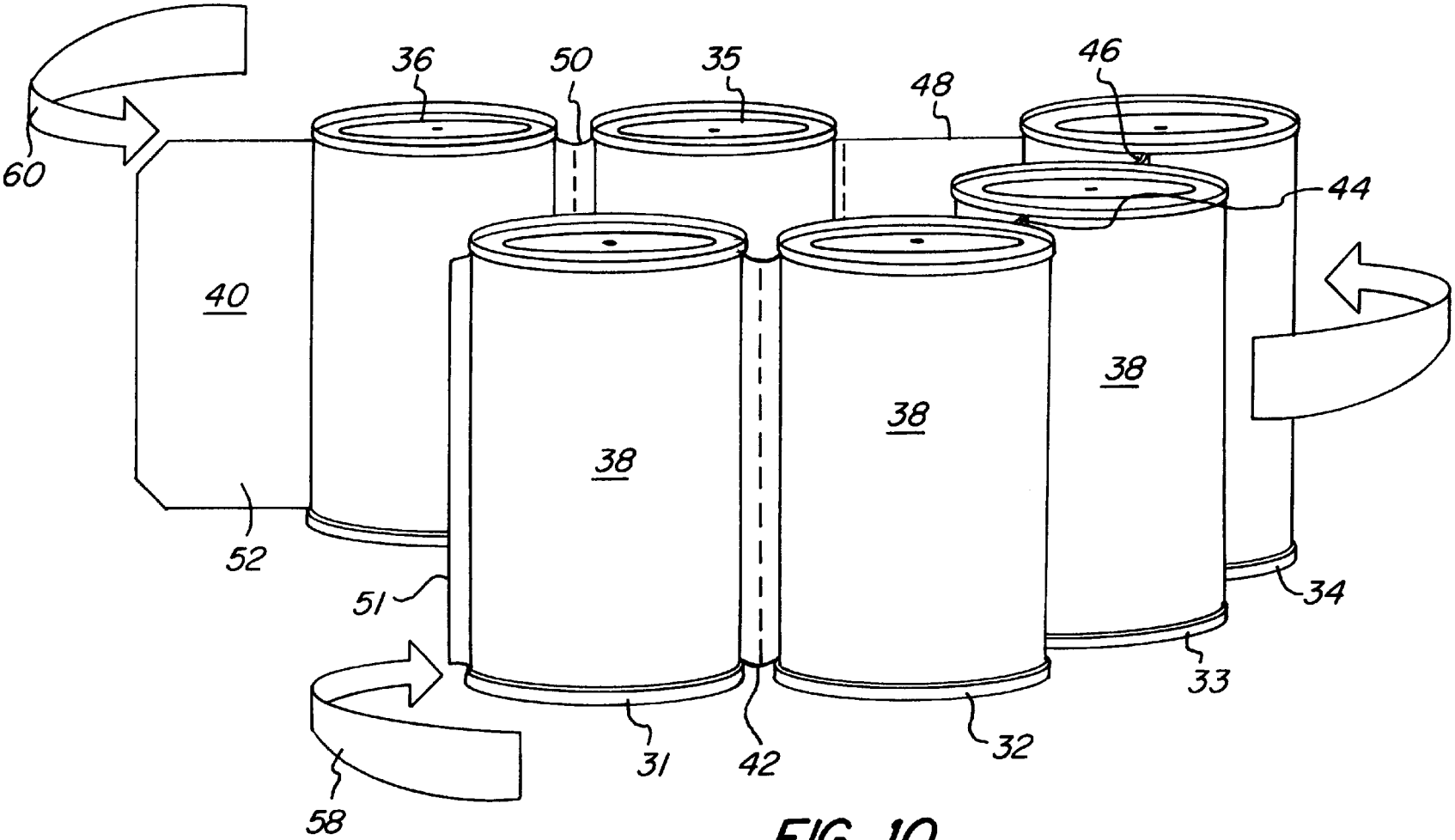

The containers of the six-pack shown in FIG. 7 are referenced 31–36, and, as shown in FIG. 8, are arranged into rows of three contiguous containers and three columns, each of two contiguous containers. With reference to FIGS. 9 and 10, each of the containers is sandwiched between two strips of high tear strength paper 38 and 40 which, like the strips 6 and 7, are pre-treated with adhesive and are pre-printed with the container labels.

The strips 38 and 40 are sealed together between the cans to define five connecting portions 42, 44, 46, 48 and 50. The adjacent ends of the strips 38 and 40 are sealed together to form a seam 51 and a flap 52 respectively.

Each of the connecting portions 42, 44, 46 and 50 has a single line of perforations thereon which perform a similar function to the perforations of the four-pack. However, the connecting portion 48, which is considerably longer than the other connecting portions, includes two parallel lines of perforations 54 and 56. As with the first described embodiment, all the connecting portions can, in a modified version, have two parallel lines of perforation.

Figure 11:
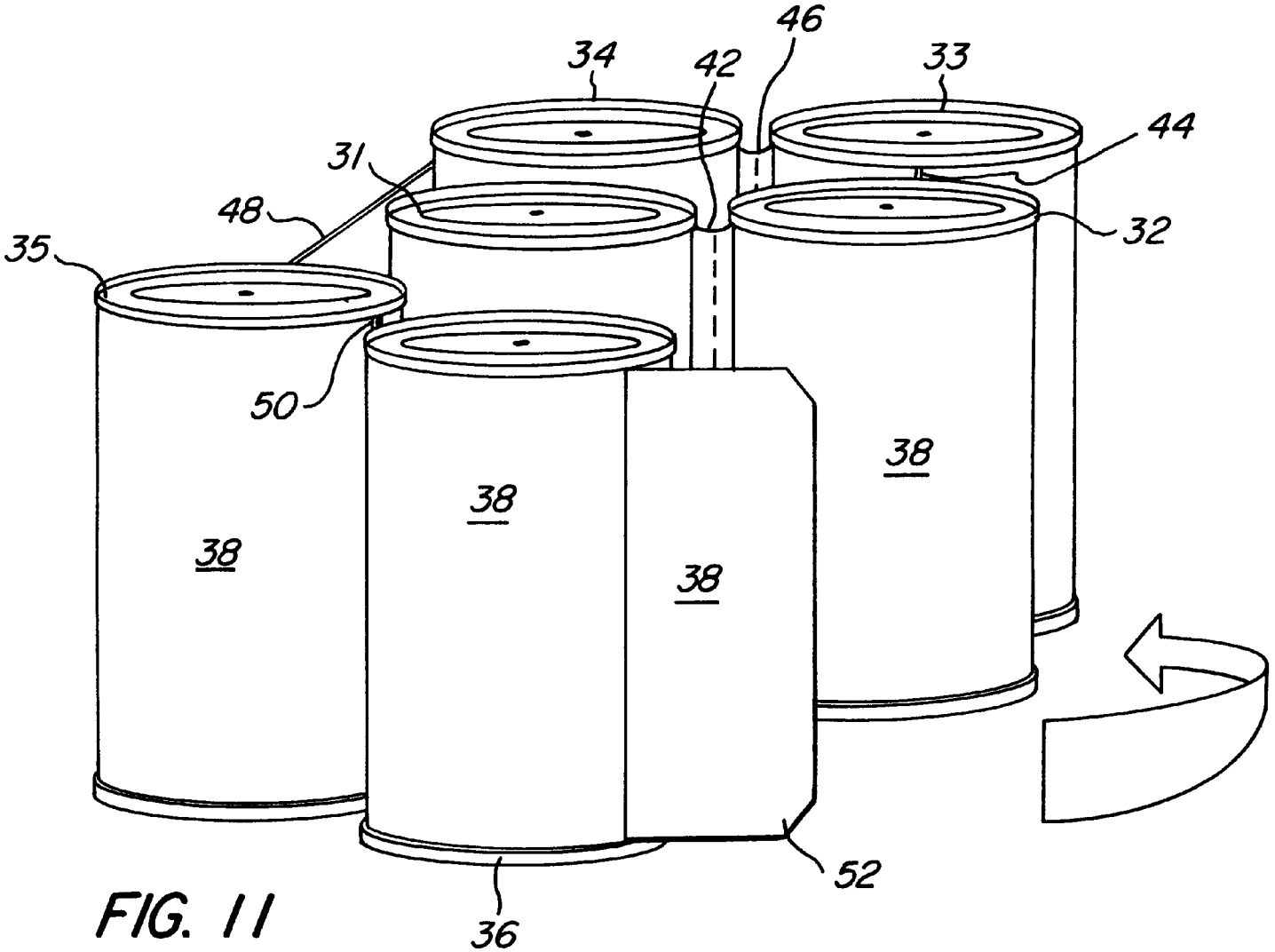

In order to form the linear array of containers as shown in FIG. 9 into the configuration shown in FIG. 8, the containers 31, 32, 33 and 34 are first formed into a four-pack configuration similar to that shown in FIGS. 1–3. The containers 35 and 36 are then rotated relative to the containers 31–34 about the connecting portion 48 so that the cans 35, 36 and the connecting portion 48 are effectively wrapped around two sides of the other cans (FIG. 11).

The can 36 is then secured to the can 32 by means of the flap 40.

Referring back to FIG. 8, it can be seen that the connecting portion 48 effectively bridges the column defined by the cans 31 and 32, and that the strips of paper defining the can labels and the connecting portions follow a generally spiral inward path from the flap 52 to the seam 51. It will be seen that the can 31 is held in position in the multi-pack by the force exerted thereon by the cans 35, 34 and 32, and by the connecting portions 42 and 48.

Since the connecting portion 48 extends across the whole width of the six-pack, it can carry a suitably large graphic for the whole pack.

As with the four-pack, the connecting portions are under tension. To that end, the connecting portions 48 and 50 project from the container 35 from positions which lie on a chord which is displaced towards the outside of the multi-pack from the centre of the container. Connecting portions project from corresponding positions on the cans 33 and 34, as do the connecting portion 50 and flap 52 from the can 36.

Figure 12:
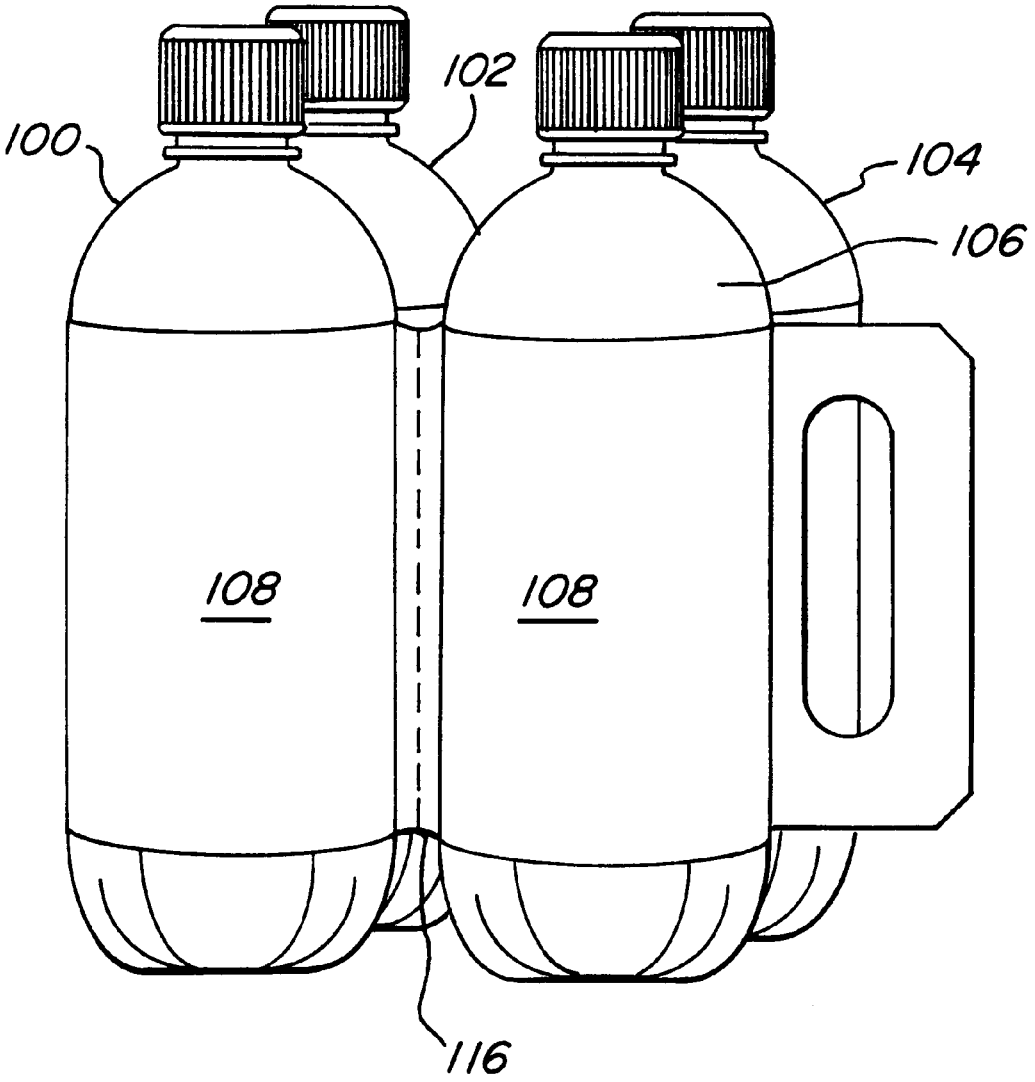
FIG. 12 is a side view of a third multi-pack.

The multi-pack shown in FIG. 12 comprises four screw top bottles 100, 102, 104 and 106 each containing for example a beverage.

Figure 14:
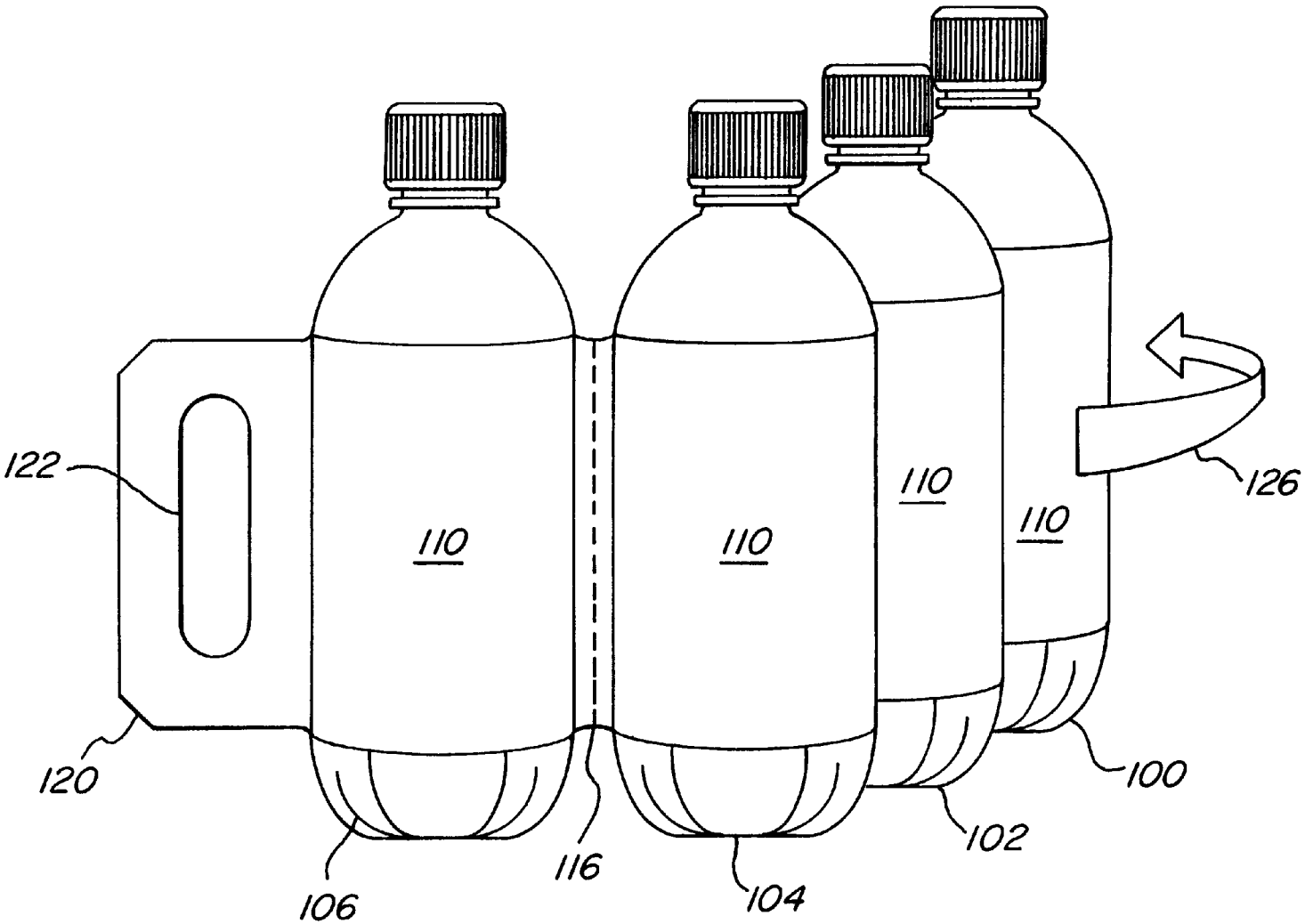

Each bottle has a cup-shaped base portion, and a generally cylindrical wall portion extending from the base portion. It will be understood that bottles having a non-circular cross-section, for example, generally octagonal, oval or square cross-section, could be used. The bottles are held together in a block of two rows and two columns each of two containers by means of two strips of polythene 108 and 110 (FIG. 14). The strips have a transverse extent corresponding to the height of the wall portions of the bottles.

Figure 13:
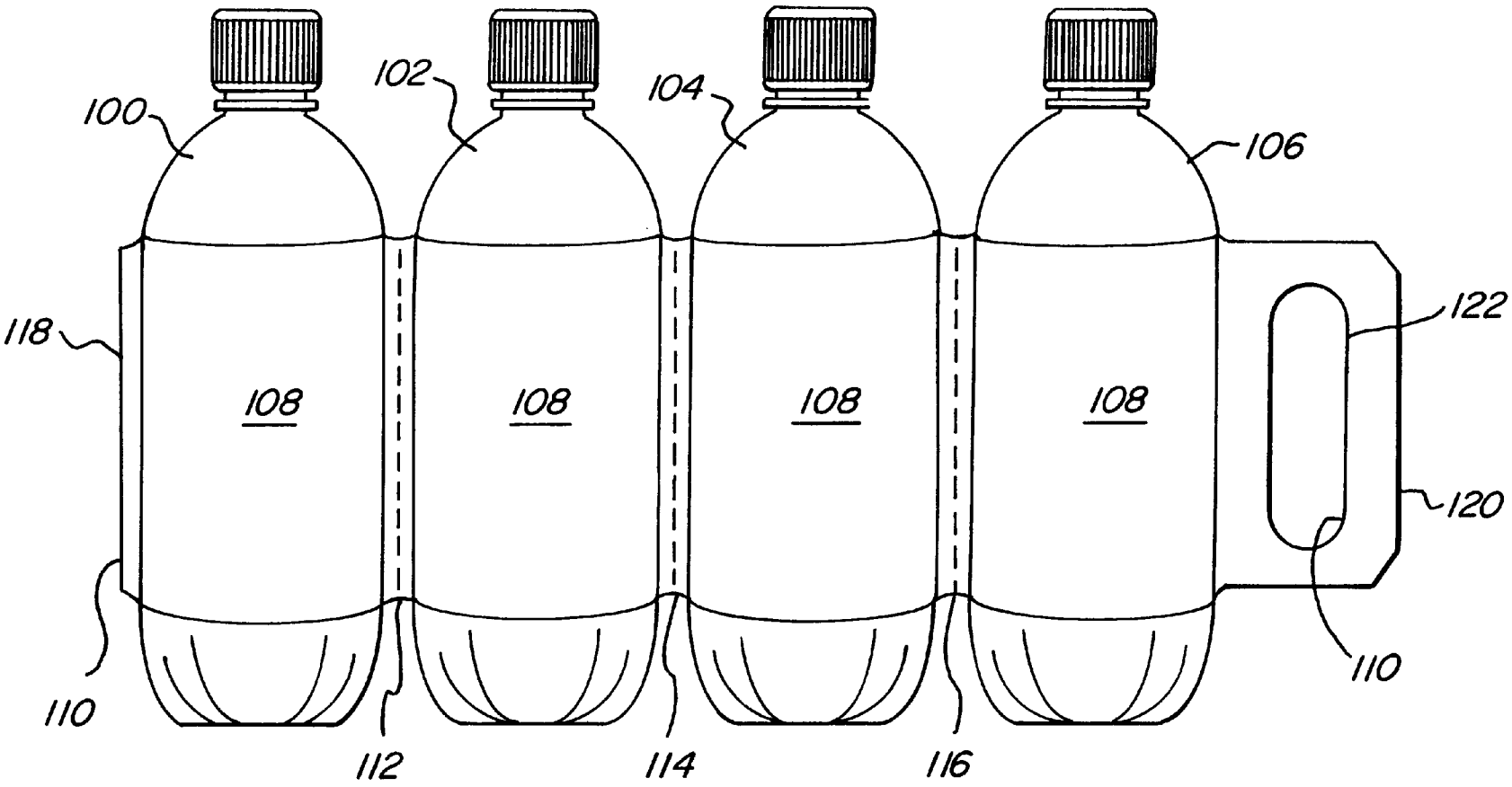
FIGS. 13 and 14 are views of the third multi-pack which respectively correspond to FIGS. 4 and 5.

With reference to FIG. 13, the polythene strips 108 and 110 are heat sealed together at intervals to provide connecting portions 112, 114 and 116, each extending between a respective pair of the bottles, and to provide pockets, each of which accommodates a respective one of the bottles. The sheets 108 and 110 are also joined together at their corresponding ends to define a flap 118 and a portion 120. The portion 120 is formed with an aperture 122, which provides a handle for carrying the multi-pack.

The sealing together of the strips 108 and 110 occurs with the bottles in situ (in a configuration similar to that shown in FIG. 13) in such a way that each bottle is gripped by each respective pocket with sufficient force to retain the bottle in the pocket without the need for any adhesive to stick the strips 108 and 110 to the bottles.

Each of the connecting portions 112, 114 and 116 is formed with a respective line of perforations which enables a selected one of the bottles to be torn away from the rest of the multi-pack. In a modified version of this embodiment, each connecting portion can include two parallel lines of perforations which define a respective tear away strip.

With reference to FIG. 14, the bottles 100 and 102 are hinged relative to the bottles 104 and 106 about the connecting portion 114 (see FIG. 13) in the direction of the arrow 126 until the bottle 100 abuts the bottle 106, and the successive connecting portions are mutually at right angles. The flap 118 (see FIG. 13) can then be heat sealed to the inboard end of the portion 120 to secure the bottles in the multi-pack configuration shown in FIG. 12.

The polythene constituting the strips 108 and 110 is transparent, so that the labels of the bottles are visible through the packaging for the multi-pack.

It will be appreciated that the invention is not limited to any particular type of container, nor any particular type of sheet material for forming the multi-pack. Thus the containers for the multi-pack could, for example, be cartons or sachets. The containers, regardless of type, could be held together by paper, polypropylene, PVC, PET or sheet material constituted by a laminate of various different types of material. In one embodiment, the packaging material is a laminate which has a layer of material which is not readily heat sealable to itself, and a further layer of material which is readily heat sealable to itself. The invention is also applicable to multi-packs of containers of things other than food or drink, for example, cleaning substances or motor oil. It will also be appreciated that the invention could lie in a multi-pack having fewer than four or more than six containers.

The invention is also applicable to multi-packs of sets of containers. In this situation, containers such as cans, are provided in sets, each set comprising plural containers, for example three containers. Within each set of containers the containers may then be disposed, for example side by side, or one on top of the other and treated like a single container. Thus the sets are interposed between opposed strips of packaging material, and the strips secured between the adjacent sets of containers, rather than between individual containers.

We claim:

1. A packaging method comprising the steps of interposing a plurality of containers between first and second opposed web portions of material;

securing the web portions together at regions between adjacent containers, whereby the material extends at the periphery of the containers and provides a hinged connecting portion between adjacent containers;

providing at an end of the web portions, a flap projecting from a first container, said flap comprising a portion of said material;

disposing the containers in a multi-pack configuration wherein said connecting portions are in tension;

securing said flap to another container of said plurality of containers;

whereby said containers are retained in said multi-pack configuration.

2. A packaging method as claimed in claim 1 wherein the flap providing step comprises forming the flap from free adjacent ends of the first and second web portions.

3. A packaging method as claimed in claim 2 wherein the flap forming step comprises attaching the ends of the web portions together by adhesive.

4. A packaging method as claimed in claim 2 wherein the flap forming step comprises heat sealing the ends of the web portions together.

5. A packaging method as claimed in any preceding claim wherein the disposing step comprises disposing the containers such that successive connecting portions are mutually substantially perpendicular.

6. A multi-pack comprising a plurality of containers, each having a respective label attached thereto, and packaging for holding said plurality of containers together, wherein the packaging is formed from a continuous strip of sheet material which constitutes at least part of the labels of all the containers, said continuous strip further forming a plurality of connecting portions each of which extends from one to the other of a respective contiguous pair of the containers to join those containers together, the continuous strip extending into a flap projecting from a first container from said plurality of containers which, by virtue of being at a region of an end of the strip, has only one said connecting portion extending therefrom, wherein said flap secures said first container to a second container such that said connecting portions are in tension and relative movement of individual containers of said plurality of containers is prevented.

7. A multi-pack as claimed in claim 6 wherein successive connecting portions are mutually substantially perpendicular.

8. A multi-pack as claimed in claim 6 wherein said plurality of containers comprises four containers, the four containers being arranged in an array which, viewed in plan, consists of two rows and two columns, each row and column having two contiguous containers, wherein said containers of each column are joined to each other, and to respective containers in the other column, by corresponding connecting portions, whereby said containers in one row are joined together by said flap.

9. A multi-pack as claimed in claim 6 wherein said plurality of containers comprises more than four containers, the containers being disposed in n columns, each of m contiguous containers, and m rows each of n contiguous containers, and n is three or more, and wherein one of the connecting portions constitutes a bridging connecting portion which extends from an end of a third container at an end of a first column at one side or from an end of a first row, to a fourth container at a corresponding position in a second column at the opposite side of the rows, said flap extending from said first container at the opposite end of said second column to said second container in a corresponding position in another column, wherein said bridging connecting portion engages at least one container in an intermediate column between said first and second columns.

10. A multi-pack as claimed in claim 9 wherein at least one container in the intermediate column between said first and second columns is a container which, by virtue of being at the end of the strip, only has one connecting portion projecting therefrom.

11. A multi-pack as claimed in claim 6 wherein the strip is one of a pair of such strips, between which each container is sandwiched, the entire label of each container being constituted by said strips.

12. A multi-pack as claimed in claim 6 wherein the connecting portions of the two strips are joined together so as to provide composite connecting portions, each of which preferably has a thickness which is at least the sum of the thickness of the individual strips.

13. A multi-pack as claimed in claim 6 wherein each strip is of high tear strength paper.

14. A multi-pack as claimed in claim 6 wherein each connecting portion includes a line of weakening for enabling a connecting portion to be spit into two, and thus to allow each container to be separated from the other containers in the multi-pack when needed.

15. A multi-pack as claimed in claim 13 wherein the strips are attached to the containers, and to each other, in the connecting portions, by means of an adhesive.

16. A multi-pack comprising a plurality of containers held together by packaging, the packaging comprising at least one continuous strip of sheet material, between respective portions of which each container is sandwiched, the portions being secured together at intervals to provide hinging connecting portions each of which extends between, and joins together, a respective contiguous pair of containers, and the continuous strip of sheet material further forming a flap extending from one of said containers and secured to a second of said containers such that said connecting portions are under tension and said containers are retained in a multi-pack configuration.

17. A multi-pack as claimed in claim 16 wherein the sheet material comprises a continuous elongate strip engaging each of said plurality of containers.

18. A multi-pack as claimed in claim 16 wherein the packaging comprises two opposed strips of material bonded together at their corresponding ends.

19. A multi-pack as claimed in claim 16 wherein consecutive connecting portions are mutually disposed substantially at right angles.

20. A multi-pack as claimed in claim 18 wherein the strips are of a transparent material.

21. A multi-pack as claimed in claim 18 wherein the sheet material comprises a plastics material.

22. A multi-pack as claimed in claim 20 wherein the strips are bonded together at their ends and at said intervals by a process of heat sealing.

23. A multi-pack as claimed in claim 22 wherein the sheet material comprises a laminate, having a layer of material which is not readily heat sealable to itself, and a further layer of material, which is readily heat sealable to itself.

24. A multi-pack as claimed in claim 18 wherein the containers are gripped by the sheet material, thus avoiding the need for any adhesive.

25. A multi-pack as claimed in claim 18 wherein the multi-pack includes a handle which is integrally formed in one of the two pairs of corresponding ends of the strips.

* * * * *